United States Patent [19]

Sejimo et al.

[11] Patent Number: 4,809,658

[45] Date of Patent: Mar. 7, 1989

[54] ANTI-OVERRUNNING DEVICE FOR AN INTERNAL COMBUSTION ENGINE

[75] Inventors: Yoshimi Sejimo, Urayasu; Toshiaki Tsubai, Sendai; Teruhiko Tobinai, Izumi, all of Japan

[73] Assignee: Walbro Far East, Inc., Kawasaki, Japan

[21] Appl. No.: 102,113

[22] Filed: Sep. 29, 1987

[30] Foreign Application Priority Data

Apr. 13, 1987 [JP] Japan ..... 62-88689

[51] Int. Cl.[4] ..... F02D 9/02

[52] U.S. Cl. ..... 123/378; 123/198 D; 123/376

[58] Field of Search ..... 123/332, 333, 351, 360, 123/376, 378, 392, 198 D

[56] References Cited

U.S. PATENT DOCUMENTS 4,274,376 6/1981 Tsiang et al. ..... 123/360
4,696,264 9/1987 Vondernau et al. ..... 123/378 X

FOREIGN PATENT DOCUMENTS 172439 10/1983 Japan ..... 123/351
46344 3/1984 Japan ..... 123/378
228736 11/1985 Japan ..... 123/376
261940 12/1985 Japan ..... 123/378
1835 1/1986 Japan ..... 123/378

*Primary Examiner*—Tony M. Argenbright
*Attorney, Agent, or Firm*—Barnes, Kisselle, Raisch, Choate, Whittemore & Hulbert

[57] ABSTRACT

An anti-overrunning carburetion system which includes a carburetor with a throttle valve for opening and closing the venturi passage and a pressure responsive actuator having a pressure chamber for actuating the throttle valve to a closing position against a spring bias. A vibration responsive pneumatic pump, having also a pressure chamber, is connected to direct pressure directly to the pressure chamber of the actuator. A vibration sensor in the form of a spring backed ball is mounted to be subject to vibrations of an engine and is in communication with the pressure chamber of the pump and to atmosphere. In response to overrun conditions of the engine, the sensor will connect the pump pressure chamber to atmosphere and allow pressure to develop in the pressure chamber to be directed to the actuator, thus causing the actuator to reduce the throttle opening.

2 Claims, 4 Drawing Sheets

ANTI-OVERRUNNING DEVICE FOR AN INTERNAL COMBUSTION ENGINE

REFERENCE TO RELATED APPLICATIONS

Reference is made to the following United States applications which are assigned to an assignee common to the present application:

Ser. No. 102,133—Filed Sept. 29, 1987
Ser. No. 102,134—Filed Sept. 29, 1987
Ser. No. 102,354—Filed Sept. 29, 1987
Ser. No. 102,383—Filed Sept. 29, 1987.

FIELD OF INVENTION

The present invention relates to a device for inhibiting overrunning of an internal combustion engine utilizing engine vibrations.

OBJECTS AND FEATURES OF THE INVENTION

Portable working machines generally use a two-stroke engine as a power source. Particularly, a diaphragm type carburetor is employed to thereby make it possible to operate a machine in all attitudes. Accordingly, the two-stroke engine is often used for a chain saw, a brush cutter, etc. Generally such a portable working machine is operated with a light-weight, small-size and high-output internal combustion engine in order to enhance the working properties. However, in the chain saw or the brush cutter, when a throttle valve of a carburetor is totally opened under circumstances of a light or no torque load, the engine starts overrunning wherein the R.P.M. becomes excessive and may cause damage to the engine before a load is applied. The overrunning operation can likewise occur after the cutting work has been completed and the torque load is removed.

The overrunning may be avoided if the throttle valve is restored to a low setting every time there is an interruption of the work. However, because the intermittent work is repeatedly carried out, the operator often fails to cut back the throttle, thus resulting in damage to and shortening of the life of the engine.

In the past, this overrunning has been controlled by supplying an overrich fuel mixture to the engine when a throttle valve is fully opened or nearly fully opened under conditions of no or low torque load. However, this system increases the fuel consumption. Also, the ignition plug can become easily fogged, and exhaust fumes increase. Tar or the like tends to accumulate in the muffler.

The present inventors have proposed an anti-overrunning device as disclosed in Japanese Patent Application Laid-Open No. 1835/1986. In this device, a vibrating pump is normally driven to directly supply pressure air to an actuator, but the diaphragm of the vibrating pump is always unsteady due to the vibrations of the engine and, as a result, the operating stability is poor. Also, it is difficult to set an actuating point at which a throttle valve is closed by an actuator during overrunning of the engine. Furthermore, the vibrating pump in the above device is provided with a spring to force back the diaphragm, and therefore the amplitude of the diaphragm is restricted. The vibrating pump would have to be increased in size in order to obtain a sufficient pump capacity.

It is therefore an object of the present invention to provide a new anti-overrunning device for an internal combustion engine in which the engine may be run at a reasonable consumption amount of fuel in all running conditions, and, in an overrunning condition (running in excess of a set number of revolutions), a throttle valve is automatically actuated in a closing direction to reduce the amount of fuel mixture reaching the engine, in order to overcome the aforementioned problems.

In order to achieve the above-described object, the present invention provides an arrangement characterized in that a vibration sensor is connected at one end to atmosphere and at the other end to a passage communicating with a chamber of a vibrating pump, which pump normally feeds pneumatic pressure to an actuator. The actuator has a rod which is retracted by means of a spring to urge a throttle valve lever in a closing direction of an associated throttle valve when the sensor is actuated by vibration.

BRIEF DESCRIPTION OF THE OPERATION

Figures 1, 2:
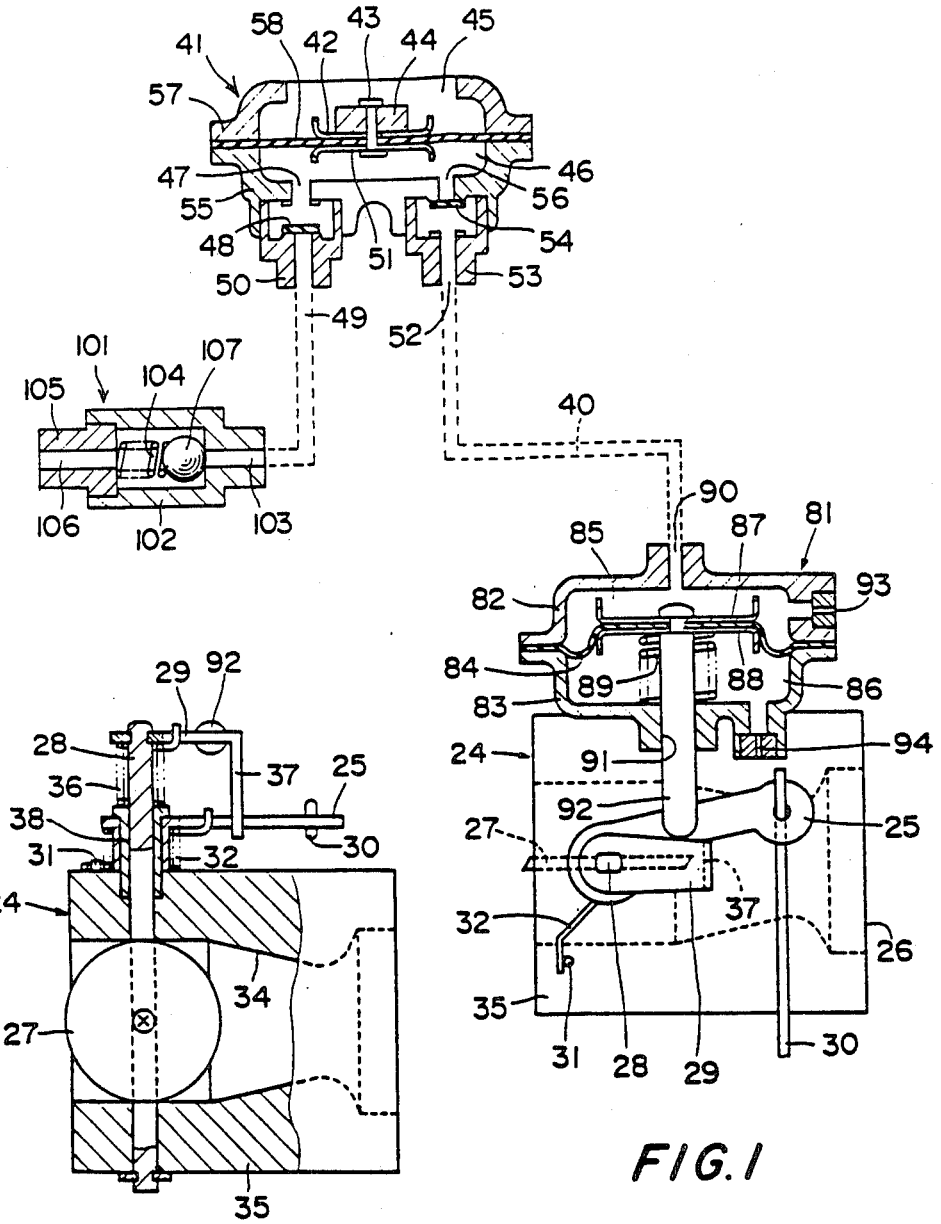
FIG. 1 is a side view showing the structure of an anti-overrunning device for an internal combustion engine according to the present invention.
FIG. 2 is a horizontal sectional view of a carburetor on which the anti-overrunning device is mounted.

In the normal running condition of the engine, since the passages 49 (FIG. 1) and 152 (FIG. 5) of a vibrating pump are closed by balls 107 and 207 of vibration sensors 101 and 201, the vibrations of the weights 44 and 144 of the vibrating pumps 41 and 141 are restrained to impede the pumping action. At that time, the rods 92 and 192 of the actuators 81 and 181 are retracted by the force of the springs 89 and 189, respectively.

In the overrunning condition, the vibration of the engine becomes violent, the ball 107 and 207 of the vibration sensor 101 and 201 move against the force of the spring 104 and 204, and passages 49 and 152 are opened. As the vibrating pump 41 and 141 receive the vibration of the engine, the diaphragms 58 and 158 along with the weight 44 and 144 are vibrated. Accordingly, positive or negative air pressure is supplied from the vibrating pump 41 and 141 to a pressure chamber 85 and 185 of the actuator 81 and 181, and the rods 92 and 192 are projected. A throttle valve lever 29 as well as a valve shaft 28 are rotated by the rods 92 and 192 to reduce the opening position of a throttle valve 27. In this manner, the quantity of the fuel and air mixture supplied to the engine is reduced. As a consequence, the number of revolutions of the engine is lowered and the overrunning is automatically prevented.

DETAILED DESCRIPTION OF THE INVENTION

Figure 3:
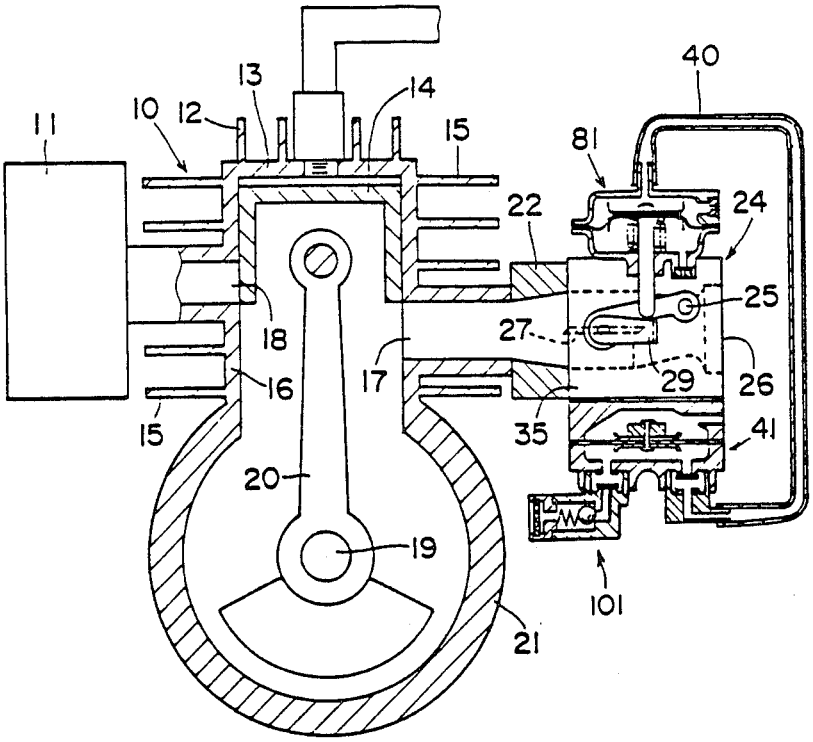
FIG. 3 is a side sectional view of the internal combustion engine provided with the anti-overrunning device.

In the internal combustion engine 10, as shown in FIG. 3, a cylinder 16 having cooling fins 15 is closed at its upper end by a cylinder head 13 having cooling fins 12, and a crank case 21 is connected to the lower end thereof. A piston 14 fitted in the cylinder 16 and a crank shaft 19 supported on the crank case 21 are connected by a connecting rod 20. When the piston 14 is up, a mixture (a mixture of fuel and air) is taken into the crank case 21 from an intake port 17. The mixture is supplied to a chamber between the cylinder head 13 and the piston 14 when the piston 14 is down. As the piston 14 moves up, the mixture is compressed, and fuel is fired near the top dead center. The piston 14 is moved downward by the explosive force, and simultaneously the combustion gas is exhausted outside via the muffler 11 from an exhaust port 28. A carburetor 24 is connected to the intake port 17 through a heat insulating pipe 22. An air cleaner, not shown, is connected to an end wall 26 of a body 35 of the carburetor 24.

As shown in FIG. 2, a throttle valve 27 is supported by the valve shaft 28 in a venturi 34 formed on the body 35, and fuel is supplied to the venturi 34 by negative pressure of air passing through the venturi 34. Such a fuel supplying mechanism is known, for example, in U.S. Pat. No. 3,738,623 and directly has nothing to do with the gist of the present invention and will not be further described.

An upper end of the valve shaft 28 is rotatably supported on the body 35 by means of a bearing sleeve 38, and an inverted L-shaped throttle valve lever 29 is secured to the upper end. One end of a spring 36 wound around the valve shaft 28 is placed in engagement with the throttle valve lever 29 and the other end thereof placed in engagement with the bearing sleeve 38. Also, a boss portion of the lever 25 is slipped over the bearing sleeve 38, and one end of a spring 32 wound around the boss portion is placed in engagement with the lever 25 whereas the other end is placed in engagement with a pin 31 on the body 35. An engaging portion 37 of the throttle-valve lever 29 is projected downwardly so that it may engage with the edge of the lever 25.

In FIG. 1, the throttle valve lever 29 is pivotally urged counterclockwise by the force of the spring 36 to cause the engaging portion 37 to abut against the lever 25. The lever 25 is pivotally urged clockwise by the strong force of the spring 32 to close the throttle valve 27. When the lever 25 is rotated counterclockwise against the force of the spring 32 by a trigger wire 30, the throttle valve lever 29 also follows the lever 25 to increase the fuel-air passage controlled by the throttle valve 27.

The anti-overrunning device for the internal combustion engine according to the present invention is composed of a vibrating pump 41, a vibration sensor 101, and an actuator 81 for reducing the opening controlled by the throttle valve 27 through the throttle valve lever 29.

The vibrating pump 41 has a diaphragm 58 sandwiched between cup-like housings 57 and 55 to form an atmospheric chamber 45 and a pressure chamber 46. Pad plates 42 and 51 are placed on both surfaces of a diaphragm 58, and a weight 44 is connected by means of a rivet 43. The pressure chamber 46 is provided with passages 56 and 47, to which port members 53 and 50, respectively, are connected. The port member 53 is provided with a check valve 54 to allow a flow of air from the passage 56 to a passage 52. The port member 50 is provided with a check valve 48 to allow a flow of air from a passage 49 to the passage 47. The passage 49 is connected to a passage 103 of the vibration sensor 101.

The vibration sensor 101 is so designed that a closure 105 having a passage 106 is connected to the end of a cup-like housing 102 and a ball 107 is urged against a seat at the end of a passage 103 by means of a spring 104 positioned in the housing 102.

The actuator 81 has a diaphragm 84 sandwiched between cup-like housings 82 and 83 to form a pressure chamber 85 and an atmospheric chamber 86. An inlet 90 of the pressure chamber 85 is connected to a passage 52 of the vibrating pump 41 by means of a pipe 40. Pad plates 87 and 88 are placed on both surfaces of the diaphragm 84, the plates being connected by the base end of a rod 92. The rod 92, slidably inserted into a hole 91 of the housing 83, is retracted by means of a spring 89 surrounding the rod 92 and interposed between the pad plate 88 and the housing 83. The fore end of the rod 92 is placed into abutment with the aforementioned throttle valve lever 29. The pressure chamber 85 and the atmospheric chamber 86 are provided with orifices 93 and 94 in communication with atmosphere respectively, whereby the extreme operation of the actuator 81 may be restricted.

Figure 4:
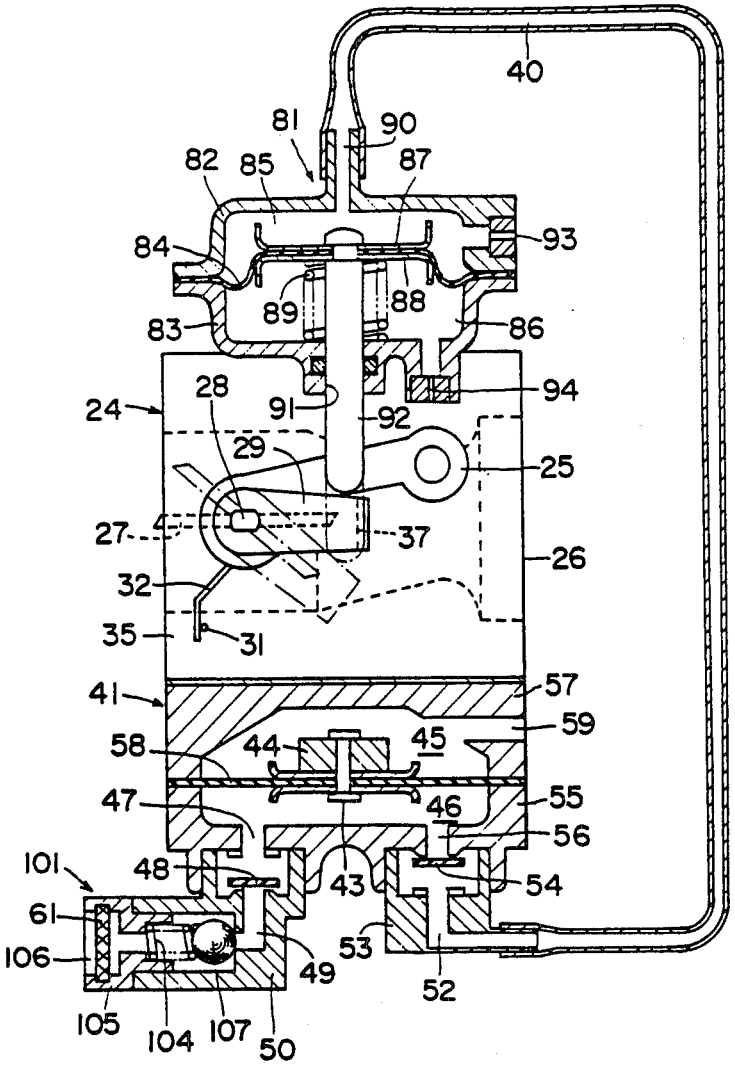
FIG. 4 is a side sectional view showing the manner in which the anti-overrunning device, according to one embodiment of the present invention, is mounted on the carburetor.

The above-described vibrating pump 41 and vibration sensor 101 are preferably integrally connected to the lower end wall of the body 35 of the carburetor 24, and the actuator 81 is connected to the upper end wall of the body 35, as shown in FIG. 3. The vibrating pump 41 and the actuator 81 are connected by the pipe 40. However, the vibrating pump 41 and the vibration sensor 101 may be mounted suitably on the engine 10. FIG. 4 is an enlarged view showing an embodiment wherein a vibrating pump, a vibration sensor and an actuator are mounted on the body of a carburetor.

It is to be noted that the diaphragm 58 of the vibrating pump 41 can be formed from a rubber impregnated fabric, a thin resin plate, or a thin metal plate instead of a rubber fabric. The shape of the diaphragm can be of a convolution type or a bellows-phragm type rather than a flat plate. The weight 44 may be mounted interiorly of the pressure chamber 46 or mounted interiorly of both atmospheric chamber 45 and pressure chamber 46.

The actuating point of the vibration sensor 101 may be suitably set by varying the diameter and weight of the ball 107, the set load of the spring 104, the inside diameter of the seat portion of the passage 103 or 49, and the like. A configuration may be made so that the ball 107 is urged against a seat at the atmospheric opening 106 by means of a spring.

In the following, the operation of the antioverrunning device for the internal combustion engine according to the present invention will be described. Since in the state where the engine is running at less than a predetermined number of revolutions, the intensity of the vibrations of the engine is weak, the vibration sensor 101 is in its closed state, that is, the passage 49 is closed by the ball 107. Even if the vibrating pump 41 receives vibration of the engine, the low speed does not affect the weight 44 in its upward and downward vibration.

When the engine starts operating at a level above a predetermined number of revolutions, that is, in an overrunning state, the ball 107 of the vibration sensor 101 vibrates against the force of the spring 104 to open the passage 49. Also, the diaphragm 58 of the vibrating pump 41 is increasingly vibrated by the weight 44. When the diaphragm 58 is inflated upwardly, pressure of the pressure chamber 46 lowers, and therefore the check valve 48 opens to take air into the pressure chamber 46 from the atmospheric opening 106 having a strainer 61. Subsequently, when the diaphragm 58 is inflated downwardly, the air of the pressure chamber 46 causes the check valve 54 to open and is supplied to the pressure chamber 85 of the actuator 81 through the pipe 40, and the rod 92 is forced down against the force of the spring 89. Thus, the throttle valve lever 29 is rotated along with the valve shaft 28, as shown by the chain lines in FIG. 4, and the opening controlled by the throttle valve 27 is reduced. The flow rate of the fuel-air mixture taken into the engine is reduced, and the number of revolutions of the engine decreases.

When the number of revolutions of the engine decreases, the intensity of the vibrations transmitted from the engine to the vibration sensor 101 is weakened (the amplitude is small), and therefore again the passsage 49 is closed by the ball 107. Then, the air in the pressure chamber 85 of the actuator 81 gradually flows outward through the orifice 93, and the rod 92 is raised upward by the force of the spring 89. The throttle valve lever 29 is rotated counterclockwise by the force of the spring 36, and the engaging portion 37 impinges upon the edge of the lever 25. In this manner, the opening degree of the throttle valve 27 increases, and again the number of revolutions of the engine increases.

In general operation, the position of the throttle valve 27 is determined by the rotated position of the lever 25 operated by the trigger wire 30. When the number of revolutions of the engine again increases and exceeds a predetermined number of revolutions, the vibration sensor 101 again opens to supply pneumatic medium to the actuator 81, and the opening position of the throttle valve 27 is decreased. The operation as described above is repeated whereby the speed of the engine is maintained at less than a predetermined number of revolutions, and the overrunning of the engine is automatically prevented without the need of the operator's operation of the trigger wire 30 according to the variation of load.

Figure 5:
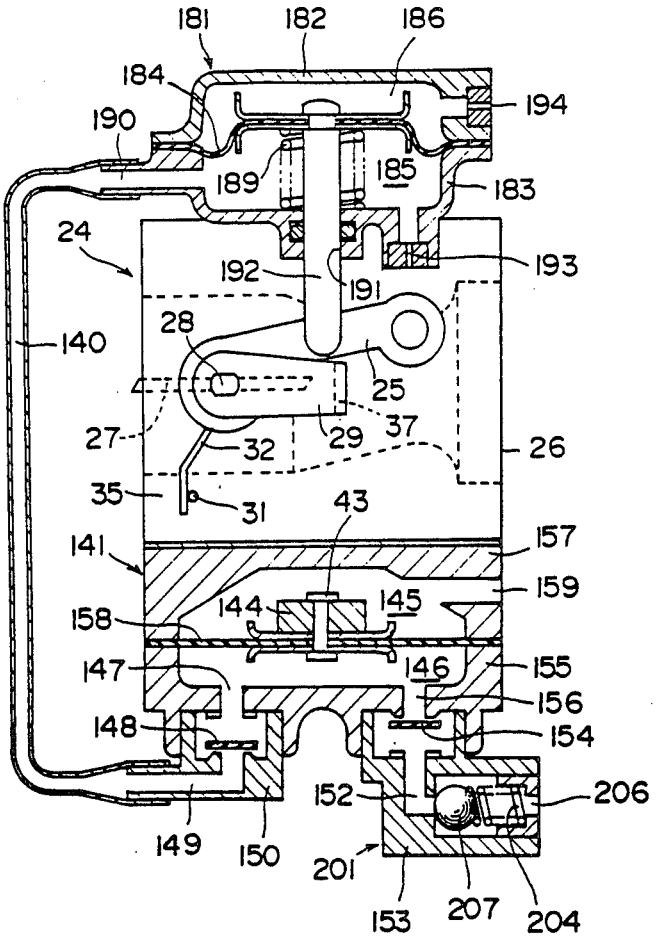
FIG. 5 is a side sectional view showing the manner in which the anti-overrunning device, according to a second embodiment of the present invention, is mounted on the carburetor.

In the embodiment shown in FIG. 5, an actuator 181 connected to the upper end wall of the body 35 of the carburetor 24 is actuated by negative pressure supplied from a vibrating pump 141. Members corresponding to those shown in FIG. 4 are indicated by reference numerals to which 100 is added. Provided in a passage 156 of the vibrating pump 141 is a check valve 154 to allow a flow of air from a pressure chamber 146 to the outside. On the other hand, at passage 147 is located a check valve 148 to allow a flow of air from the actuator 181 to the pressure chamber 146. The pressure chamber 146 is connected with the pressure chamber 185 of the actuator 181 through the pipe 140.

The vibration sensor 201 is designed so that a ball 207 is urged against a seat at the end of passage 152 by means of a spring 204 positioned in a housing integral with a port member 153 of the vibration pump 141.

The actuator 181 has a diaphragm 184 sandwiched between housings 182 and 183 to form an atmospheric chamber 186 and a pressure chamber 185, the atmospheric chamber 186 and pressure chamber 185 being communicated with atmosphere by orifices 194 and 193, respectively. A rod 192 connected to the diaphragm 184 is retracted by the force of a spring 189.

When the engine exceeds a predetermined number of revolutions to increase vibrations, a ball 207 of the vibration sensor 201 moves against the force of the spring 204 to open the passage 152 to atmosphere and the diaphragm 158 is vibrated up and down by the weight 144 of the vibrating pump 141. Accordingly, air in the pressure chamber 185 of the actuator 181 is taken into the pressure chamber 146 through the pipe 140 and the check valve 148 and thence discharged from the pressure chamber 146 through the check valve 154 and by vibration sensor 201 to the outside. In this manner, the pressure chamber 185 has a negative pressure, the rod 192 is urged down against the force of the spring 189, and the throttle valve lever 29 is rotated clockwise. The opening controlled by the throttle valve 27 is then reduced, and the number of revolutions of the engine decreases. Accordingly, the overrunning of the engine is prevented in a manner similar to that of the embodiment shown in FIG. 4.

While in the above-described embodiments, the vibration sensors are provided in the passages 49 and 152 connecting the pressure chamber of the vibrating pump with atmosphere so that in the normal number of revolutions of the engine, the pumping action of the vibrating pump is stopped, it is to be noted that the vibration sensors can be provided in the atmospheric openings 59 and 159 formed in the atmospheric chambers 45 and 145 of the vibrating pumps 41 and 141.

As described above, the present invention is characterized in that a vibration sensor is connected at one end to atmosphere and at the other end to a passage communicating with a chamber of a vibrating pump which pump normally feeds pneumatic pressure to an actuator. The actuator has a rod which is retracted by means of a spring to urge a throttle valve lever in a closing direction of an associated throttle valve when the sensor is actuated by vibration. The diaphragm of the vibrating pump is biased only by the weight and a return spring is not present. Therefore, the device can be small but a sufficient pump capacity may be obtained. Moreover, it is possible to suitably set the maximum number of revolutions of the engine according to the formulation of the vibration sensor.

According to the present invention, during the overrunning of the engine, the opening of the throttle valve of the carburetor is automatically reduced to reduce the flow rate of the mixture taken into the engine. Therefore, there is provided a new anti-overrunning device which is positive in operation, may be run at a substantially reasonable fuel cost (rate of fuel consumption) in all running levels of the engine, is free of spark plug fouling, produces less exhaust fume, and results in less tar accumulation in the muffler.

Furthermore, since the operator can perform his work while a throttle handle is left fully opened because of actuation of the anti-overrunning device, the working efficiency may be enhanced, and the damage to, and the shortening of life of, the engine may be avoided.

What is claimed is:

1. An anti-overrunning device for an internal combustion engine comprising:

(a) a carburetor having a venturi passage for a fuel and air mixture, (b) a throttle valve in said passage movable to open and closed positions to regulate the effective area of said passage, (c) an actuator including a diaphragm responsive to pneumatic pressure operatively connected to said throttle valve, (d) an inertial pump comprising a housing having a weighted diaphragm mounted on an engine and subject to engine vibrations to develop pneumatic pressure, said inertial pump having an inlet to receive atmospheric air and an outlet connected to said actuator, and (e) a vibration sensor in communication with said inertial pump inlet responsive to excessive vibration of said engine to connect said inlet to atmosphere to initiate pumping air from said outlet to said actuator to cause movement of said actuator diaphragm and said throttle valve in a closing direction to reduce the speed of the engine.

2. An anti-overrunning device for an internal combustion engine comprising:

(a) a carburetor having a venturi passage for a fuel and air mixture, (b) a throttle valve in said passage movable to open and closed positions to regulate the effective area of said passage, (c) an actuator including a diaphragm responsive to pneumatic pressure operatively connected to said throttle valve, (d) an inertial pump comprising a housing having a weighted diaphragm mounted on an engine and subject to engine vibrations to develop pneumatic sub-atmospheric pressure, said inertial pump having an inlet connected to said actuator and an outlet to be connected to atmosphere, and (e) a vibration sensor valve in said inertial pump outlet responsive to excessive vibration of said engine to connect said outlet to atmosphere to initiate pumping air from said inlet and said actuator to cause movement of said throttle valve in a closing direction to reduce the speed of the engine.

* * * * *